United States Patent [19]

Daly

[11] Patent Number: 5,077,777

[45] Date of Patent: Dec. 31, 1991

[54] MICROFOCUS X-RAY TUBE

[75] Inventor: Richard H. Daly, Lake In The Hills, Ill.

[73] Assignee: Micro Focus Imaging Corp., Wheeling, Ill.

[21] Appl. No.: 546,893

[22] Filed: Jul. 2, 1990

[51] Int. Cl.[5] ..... H01J 35/06

[52] U.S. Cl. ..... 378/136; 378/122

[58] Field of Search ..... 378/136, 122

[56] References Cited

U.S. PATENT DOCUMENTS 1,738,959 12/1929 Mutscheller ..... 378/136

4,573,186 2/1986 Reinhold ..... 378/136

*Primary Examiner*—Janice A. Howell

*Assistant Examiner*—Don Wong

*Attorney, Agent, or Firm*—Leo J. Aubel

[57] ABSTRACT

A microfocus X-ray tube having an improved cathode assembly including a filament mounting disk for adjustably mounting a flat ribbon filament or a round wire filament such that the filament extends through an aperture in a focal plane disk which provides a uniform focusing field to the filament as well as a uniform heat sink surface.

5 Claims, 3 Drawing Sheets

FIG. 5
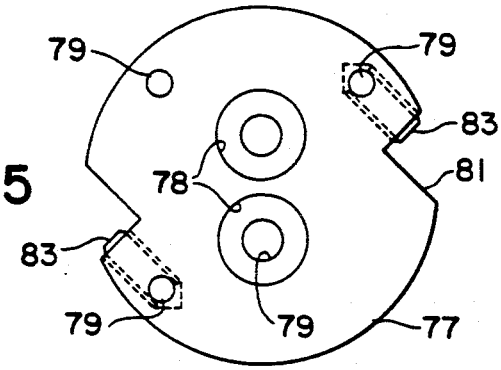
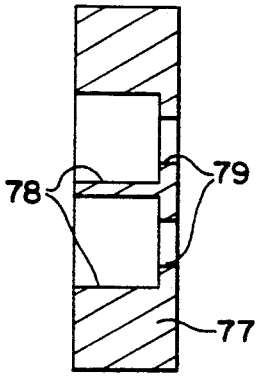
FIG. 6
FIG. 7
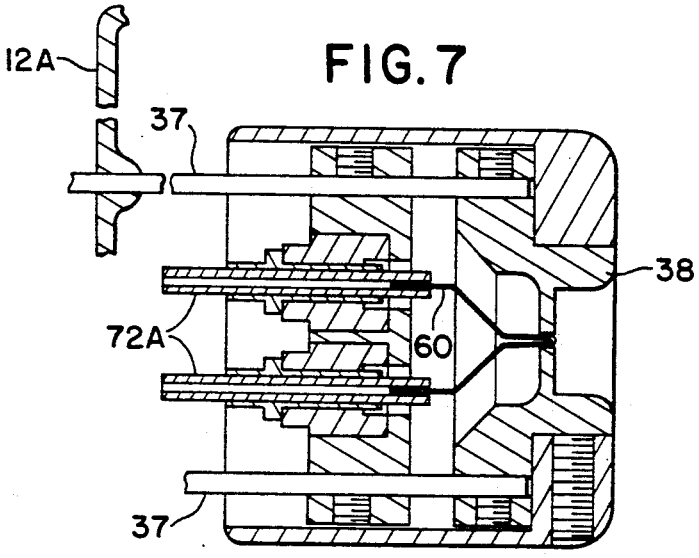
FIG. 8
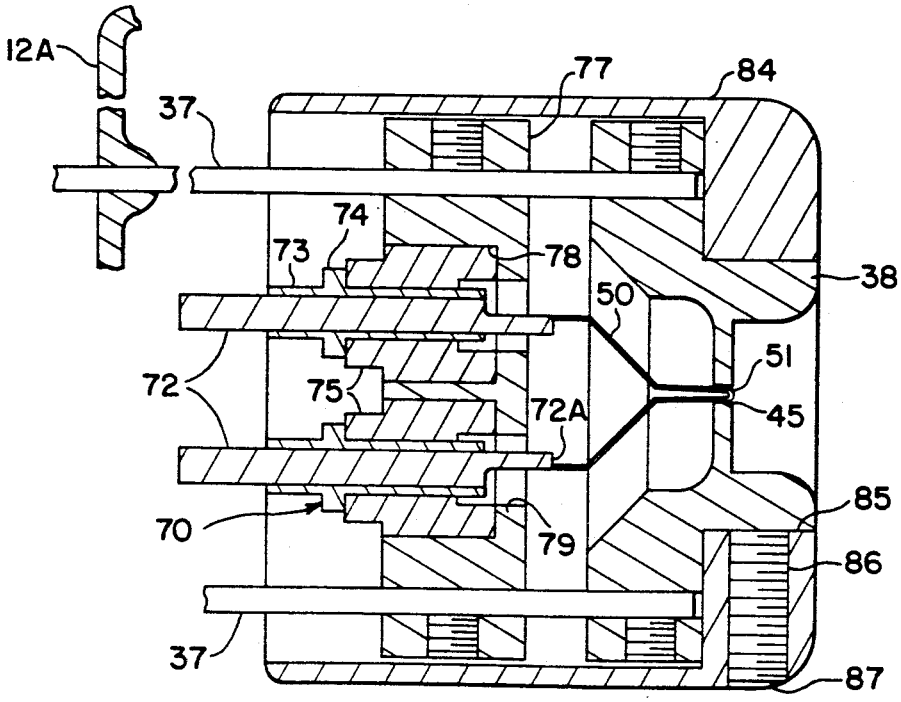

MICROFOCUS X-RAY TUBE

BACKGROUND OF THE INVENTION

This invention relates to X-ray tubes, in which an anode assembly and a cathode assembly are positioned in a vacuum-tight manner to an evacuated envelope. The anode assembly is secured by a glass seal to one end of the envelope and a cathode assembly is secured by a glass seal ring to the other end of the envelope. The anode and cathode assemblies face each other at a predetermined distance. The cathode assembly includes filament for emitting electrons which are accelerated toward the anode. The anode assembly, includes an angled tungsten target, and an anode block. The target is located at the center of the end of the target block such that it faces the filament of the cathode assembly. A window member made of an X-ray transmitting material may be provided on the envelope and in a position on the envelope adjacent the anode.

In the operation of such X-ray tube, the electrons emitted from the filament are accelerated by a voltage applied between the anode and cathode. The accelerated electrons impinge on the angled target to form a spot thereon. The angled target emits X-rays which are radiated through the window as an X-ray field emission.

SUMMARY OF THE INVENTION

An object of the invention is to provide an X-ray tube, which provides a microfocus focal spot, and wherein the filament and cathode assembly comprise a unique contruction to provide an improved tube.

In one embodiment, the cathode assembly includes a ribbon filament for generating the electron beam; and in another embodiment a single wire comprises the filament.

Further, the inventive X-ray tube comprises a structure for enabling adjusting the cathode assembly and filament relative to the target, to assure that a fine microfocus spot size is obtained.

The foregoing features and advantages of the present invention will be apparent from the following more particular description of the invention. The accompanying drawings, listed hereinbelow, are useful in explaining the invention wherein.

BRIEF DESCRIPTION OF THE DRAWING

FIG. 5 is a relatively enlarged end view of the filament mounting disk of FIG. 1;

FIG. 6 is a sectional view of the filament mounting disk of FIGS. 1 and 5;

FIG. 7 is a sectional perspective view showing the manner in which a wire filament and the focal plane disk and the filament disk are mounted in the X-ray tube envelope;

FIG. 8 is a sectional view showing the manner of mounting a flat ribbon filament to the terminal connectors;

DETAILED DESCRIPTION OF THE PREFERRED EMBODIMENTS

Figure 1:
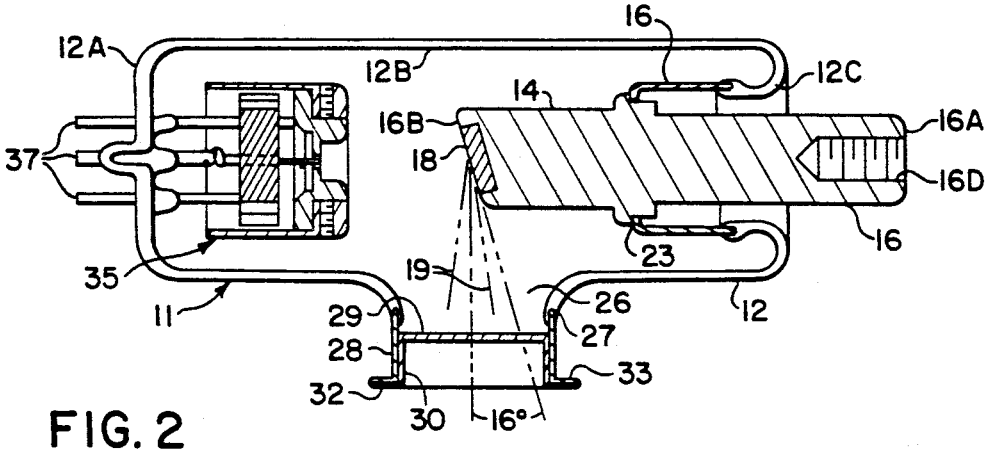
FIG. 1 is a sectional view taken along the tube axis and showing an embodiment of the X-ray tube according to the invention.

FIG. 1 is a longitudinal sectional view of the inventive X-ray tube 11. The tube 11 includes a cylindrical evacuated envelope or body 12, which is of a glass material. The envelope 12 can also advantageously be made of a ceramic material but ceramic is more expensive. The envelope 12 is formed with a relatively thick cup shaped base 12A, a relatively thinner central cylindrical section 12B, and an inwardly bent, or folded end section 12C.

Figure 2:
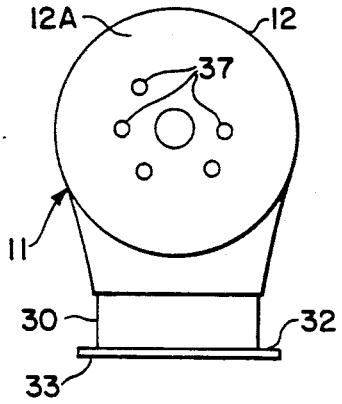
FIG. 2 is an end view of the base of the tube of FIG. 1.
Figure 3:
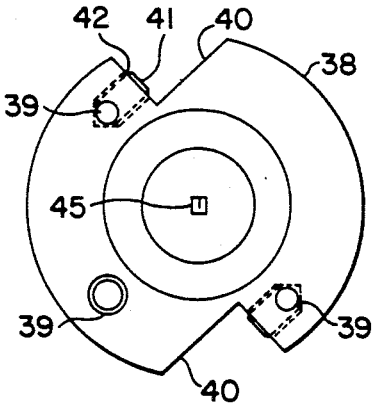
FIG. 3 is a relatively enlarged end view of a focal plane mounting disk shown in FIG. 1.
Figure 4:
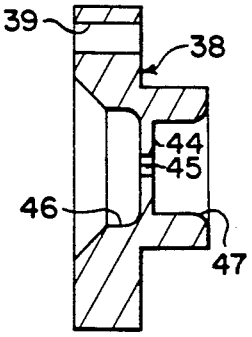
FIG. 4 is a sectional view of the focal plane mounting disk shown in FIGS. 1 and 3.

FIG. 2 is an end view of the tube 11 taken from the base 12A end.

The X-ray tube 11 has an anode assembly 14 which is mounted vacuum tightly on the inwardly bent end section 12C of envelope 12 as by glass fusing. Anode assembly 14 comprises an elongated copper rod 16. One end 16A of rod 16 extends externally of the evacuated envelope 12, and the other end 16B of anode rod 16 extends into the envelope 12. The end 16A of anode rod 16 has an axially extending recess 16D for accommodating a suitable electrical connector, not shown. The end 16B of anode rod 16 is beveled or angled at a selected angle of from 10° to 16° from the perpendicular measured in relation to the axis of rod 16.

A tungsten target 18 approximately 0.25 inches in diameter and 0.10 inch thick is cast and imbedded in a flush relation into the beveled end 16B surface of anode rod 16 to generate X-rays indicated at 19 when bombarded by an electron beam, as is well known in the art. In the embodiment shown the angle of the target 18 is 16° and the coverage angle or field of X-ray coverage is twice that angle, as will be discussed hereinbelow.

Rod 16 includes a shoulder 23, onto which a sleeve 26 such as of Kovar ® is welded. The rod 16 is mounted in envelope 16 by fusing the bent end of envelope 16C onto the Kovar ® sleeve 26, by well known methods.

Envelope 12 includes a side opening 26 with an outwardly extending flange 27. A window frame housing 28, such as of Kovar, has one end fused to the flange 27. A flat beryllium window 29 is mounted in housing 28 to provide minimum filtration of the X-ray beam 19, as is well known. Window 29 is mounted as by welding onto one end of a cylindrical foreshortened tube 30 which may be of a monel alloy. The other end of tube 30 has outwardly extending flanges 32 which mate with flanges 33 on housing 28. The tube 30, flanges 32 and window 29 are affixed in vacuum tight relation to housing 28 and flanges 33 such as by heli-arc welding.

A cathode assembly 35 is mounted on the base end 12A of envelope 12. Cathode assembly 35 is mounted on connector or terminal pins generally labeled 37 which are, in turn, fused in the base 12A, as is well known. Refer now also to FIGS. 3, 4, 7, and 8, which show focal plane disk 38 of the cathode assembly 35. Disk 38 may be of nickel metal and includes three apertures or mounting holes, generally labelled 39. Disk 38 further includes two peripheral cut-outs or notches 40 and respective threaded holes 41 (perpendicular to apertures 39) for receiving set screws 42. In assembly, the disk 38 is mounted in position by inserting terminal pins 37 through the apertures 39, exactly positioning the disk 38 by suitable fixtures, and tightening the set screws 42, all of which will be further explained hereinafter.

As best seen in the FIGS. 3, 4, 7, and 8, disk 38 includes a flat surface 44 forming a focal plane for a filament. Surface 44 includes a rectangular aperture or passage 45, which may be approximately 0.032 inches in width and 0.032 to 0.039 inches in height, for receiving a filament such as 60 in FIG. 7 and 50 in FIG. 8 and permitting passage of the electron beam generated by the filament. Disk 38 further includes a relatively large cavity 46 for accommodating the filament, as will become clear. Disk 38 includes axially extending tubular projection 47 which functions as a focusing element to focus the electron beam. Tubular projection 47 is preferably of a length of approximately 0.150 inches to 0.250 inches and has an inside diameter of about 0.250 inches.

Figure 9A:
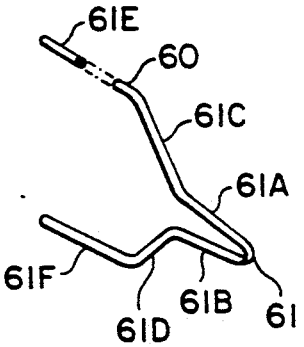
FIGS. 9*a*, 9*b*, and 9*c* show structural details of the mounting of a round wire filament relative to the focal plane disk.
Figure 9B:
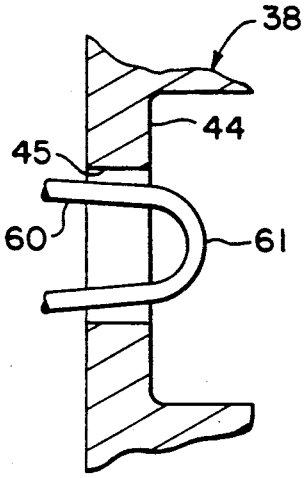
Figure 9C:
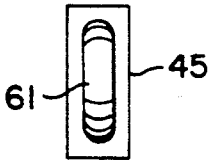

FIGS. 9*a*, 9*b*, and 9*c* show an embodiment of the invention having filament 60 formed of round wire. FIG. 9*a* is an isometric view of the filament 60, FIG. 9*b* shows a side view of the positioning and mounting of the tip 61 of the filament 60 in disk 38, and FIG. 9*c* shows the configuration of the aperture of passage 45 and the mounting of the filament 60 therein. The filament wire is bent to form a tip 61 having a radius of at least as small as 0.032 inches. The sections 61A and 61B of the filament wire adjacent the tip 61 extend downwardly at a very slight angle, then flare as at 61C and 61D at a larger angle, and next bend toward a parallel relation as at 61E and 61F. The parallel portions of sections 61E and 61F are adapted to be inserted into tubular rods 80 (See FIG. 7) and affixed thereto as by crimping the rods to the wire filament 60.

The tip 61 of filament 60 extends through aperture 45 above the focal plane or surface 44 of disk 38 0.003 to 0.005 inches (FIG. 9*b*). As shown in FIG. 9*c*, aperture 45 is rectangular and the sides of the wire filament 60 are equidistant from the four sides of the aperture. This construction is provided to accommodate the circular configuration of the wire filament 60 to provide a more uniform heat sinking function as will a more uniform potential field to the filament.

Figure 10A:
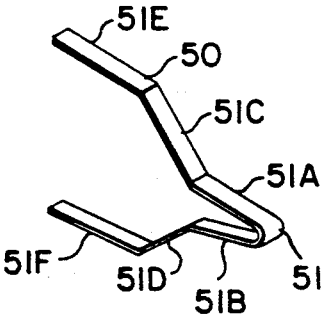
FIGS. 10*a*, 10*b*, and 10*c* show structural details of the mounting of a flat ribbon filament relative to the focal plane disk.
Figure 10B:
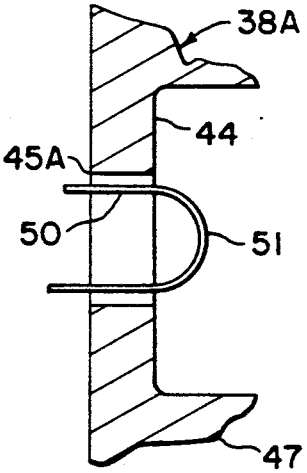
Figure 10C:
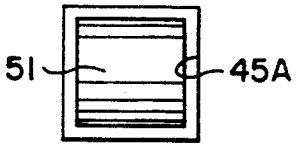

FIGS. 10*a*, 10*b*, and 10*c* show another embodiment of construction and positioning of the filament. More specifically, FIG. 9*a* is an isometric view of a flat ribbon filament 50 wherein the ribbon is bent approximately in the center to form a tip 51 having a radius at least as small as 0.032 inches. The sections 51A and 51B of the ribbon adjacent the tip 51 extend downwardly at a very slight angle, then flare out at a large angle as at 51C and 51D and then bend toward a parallel relation at 51E and 51F. The parallel portions of sections 51E and 51F are adapted to be affixed as by welding to the cut-out flat part of associated rod terminals 72 (See FIG. 8).

As shown in FIG. 10*b*, the tip 51 of the filament 50 extends through aperture 45A above the focal plane or surface 44 of disk 38 0.003 inches to 0.005 inches. Disk 38 is operated at a voltage of about −160 volts. As best shown in FIG. 10*c*, aperture 45A is square and the sides of the ribbon 5D are equidistant from the four sides of the aperture 45A. This factor provides a more uniform heat sinking function for ribbon filament as well as providing a more uniform potential field to the flat ribbon filament 50. Note that disk 38 of FIG. 9 is the same as disk 38A of FIG. 10 with the exemption that aperture or passage 45 is rectangular whereas the aperture 45A is square.

It has been found that a wire filament 60 can be more conveniently formed to produce a finer or smaller focal spot. A flat ribbon filament 50 can more conveniently provide a focal spot having higher energies (milliamperes).

The subassembly 70 for mounting the flat ribbon filament 50 is best shown in FIG. 8. As mentioned above, filament 50 is formed with a tip 51. The ends of ribbon filament 50 extend from tip 51 along a slight angle, almost parallel, for approximately 0.1 inch, and then the ribbon angles outwardly to contact respective lead or terminal connectors 72 which comprise rods of about 0.060 diameter. One end of rod connectors 72 are notched, as at 72A, to accommodate the ends 51E and 51F of the flat ribbon filament 50 which are spot welded thereto.

Each of the connectors 72 has a metal sleeve 73 crimped thereon. Sleeve 73 includes a positioning shoulder 74 which positions the sleeve 73 and connector 72 in a ceramic insulator 75. Insulator 75 in turn is received in a recess 76 of a mounting disk or block 77 which may be of metal. Note, of course that the ends 51E and 51F of ribbon filament 50 and connectors 72 are spaced from each other and that the ribbon filament 50 and connectors 72 are insulated by insulator 75 from the adjoining metal disk 77.

FIGS. 5 and 6 are useful in explaining the mounting process of the filament 50 and connector rods 72 in the mounting disk 77 shown in FIG. 7. Disk 77 is somewhat similar to disk 38 described above. Disk 77 includes three apertures or mounting holes, generally labelled 39. Disk 77 further includes two peripheral cut-outs or notches 81 and respective threaded holes (perpendicular to notches 81) which receive set screws 83. In assembly the disk 77 is mounted in position by inserting the terminal pins 37 through the apertures 79, exactly positioning the disk 77 by suitable fixtures, and tightening the set screws 83.

Disk 77 further includes two cavities 78 for receiving cylindrical shaped insulator plug 75 (See FIG. 8.) The apertures 79 which extend through the end of disk 77 and adjoin to cavity 78 receive the ends of terminal connectors 72.

Figure 11:
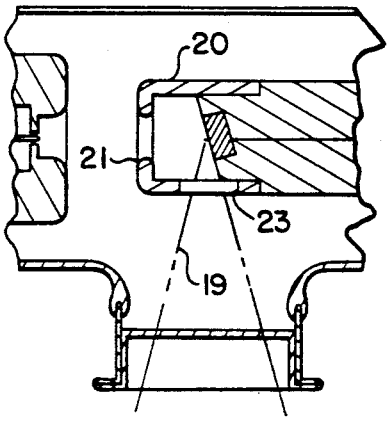
FIG. 11 shows a modification of the structure of FIG. 1 which includes an anode hood; and, FIG. 12 shows a modification of the structure of FIG. 1 wherein the tube envelope does not include a window.

FIG. 11 shows an embodiment of the invention having a copper anode hood 20. Hood 20 has an end opening 21 to admit the electron beam 22, and a side opening 23 to permit exit of the X-ray beam 19 as is well known in the art. Hood fits over the end of rod 16 and may be mounted as by welding onto the rod 16. Hood may assist in reducing scatter X-ray radiation from the target.

Figure 12:
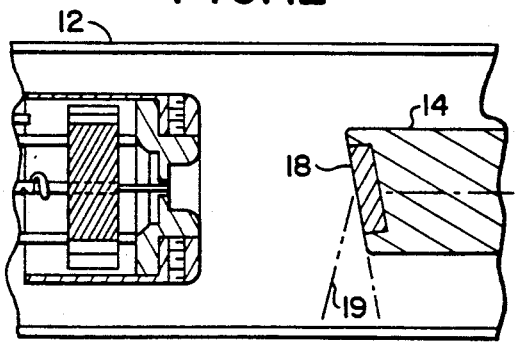

FIG. 12 shows an embodiment of the invention wherein the glass envelope 12 includes no beryllium window (See FIG. 1). This embodiment may be used where more beam filtration does not adversely affect the X-ray image quality.

FIG. 7 shows the embodiment of the invention useful in mounting the round wire filament 60 in the tube envelope 12. The structure of FIG. 7 differs from that of FIG. 8 in that the round wire of filament 61 can be more conveniently mounted in electrical connector rods 72A which are tubular. In this embodiment, the free ends of filament 60 are inserted in exact position determined by fixtures into the tubular rods 72A and crimped in position. The other structure and the process of assembly described for the embodiment of FIG. 8 is the same for the embodiment of FIG. 7.

In assembly of the structure of FIGS. 7 and 8 each of the sleeves 73 are crimped in exact position on respective rods 72. Next, the rods 72 with the sleeves 73 thereon are inserted in insulator plug 75 to a position engaging reference shoulder 74 on sleeve 73. The insulator plugs 75 with sleeves 73 and rods 72 are then placed in cavities 78 with the ends of rods 72 extending through apertures 79. Next, the pre-formed filament 50 is exactly positioned by means of fixtures on the flat portion 72A and welded thereto.

The subassembly of disk 77 is then readied for mounting on the terminal connector rods 37 of tube 11.

The connector rods 37 and base 12A of envelope 12 are formed as a subassembly, as is known. The subassembly of disk 77 is then mounted on the terminal connector rods 37 by inserting rods 37 through apertures 79 of disk 77 to an exact position determined by fixtures. Set screws 83 tighten against the rods 37 to hold the disk 77 in exact position. Next, the focal plane disk 38 is mounted (similarly as disk 77) on connector rods 37 by inserting the rods through apertures 39 in disk 38 to an exact position determined by fixtures. Set screws 41 tighten against the rods 37 to hold the disk 38 in exact position. Note, that the tip 51 of filament 50 will extend into aperture 45 of focal plane disk 38.

It is important that the tip 51 of filament be positioned at precise position relative to the focal plane surface 44 of disk 38. By maintaining a tight tolerance of the various parts of the mountina disk 77 subassembly, and the precise positioning of the parts, the anode tip 51 is caused to extend through aperture 45 past the focal plane surface 44 within a limited range. In the embodiment shown, the tip 51 of filament 50 extends past the focal plane 44 in the range of 0.003 inches to 0.005 inches. This provides a desired minimal size focal spot. After disk 38 is mounted in position a metallic cup-shaped hood or cover 84 is mounted around disks 38 and 77. An aperture 85 in the flat end of hood 84 receives the tubular projection 47 (see also FIG. 4) to permit passage of the electron beam generated by filament 50. Hood includes a threaded hole 86 for receiving a mounting set screw 87 which bears against the periphery of flange 38.

While the invention has been particularly shown and described with reference to preferred embodiments thereof, it will be understood by those skilled in the art that various changes in form and details may be made therein without departing from the spirit and scope of the invention.

What is claimed is:

1. An X-ray tube comprising an evacuated envelope having terminal connectors extending into said envelope, a cathode assembly provided in said envelope, a filament for said cathode assembly for generating an electron beam, said filament formed of a length of flat ribbon, said length of flat ribbon being formed to have a folded tip in a central portion thereof, lengths of said ribbon extending on either side of tip and portions thereof being affixed to selected terminal connectors, a focal plane disk having a flat surface forming a focal plane assembly, said disk having a central aperture for receiving said tip of said filament, means connecting an electrical potential to said disk, an anode assembly provided in said envelope and facing said cathode assembly, target means positioned on said anode assembly to receive said electron beam and generate an X-ray beam in response thereto, said target means positioned to radiate said X-ray beam to form a selected field of radiation, said tip of said ribbon filament extending through said aperture to a position wherein the end of the tip is in the range of 0.003 to 0.005 inches past said focal plane towards said anode.

2. A cathode assembly as in claim 1 wherein the interior radius of said tip is 0.006 inches whereby said tip provides an electron beam to effect a microfocus focal spot less than 50 microns in span.

3. A cathode assembly as in claim 2 wherein said ribbon filament is 0.020 inches in width and 0.004 inches in thickness.

4. An X-ray tube as in claim 1 further including a plurality of terminal pin connectors extending into said envelope, said focal plane disk having apertures therethrough for receiving terminal pins extending therethrough, screw means for affixing said focal plane disk to said terminal pins, said cathode assembly further including a filament mounting disk, said mounting disk having apertures therethrough for receiving terminal pin connectors extending therethrough, screw means for affixing said mounting disk to selected terminal connectors, said mounting disk having cavities formed therein, apertures insulator plugs received in said cavities, the ends of said ribbon filament being affixed to selected terminal connectors, sleeves having reference shoulders thereon affixed to said terminal connectors affixed to said filament, said sleeves being positioned to abut said insulator plugs and thereby position the tip of said filament in position to extend through said focal plane disk.

5. An X-ray tube as in claim 1 further including a plurality of terminal pin connectors extending into said envelope, and said focal plane disk having apertures therethrough for receiving terminal pins extending therethrough, means for affixing said focal plane disk to said terminal pins, said cathode assembly further including a filament mounting disk, said mounting disk having apertures therethrough for receiving terminal pin connectors extending therethrough, means for affixing said disk to selected terminal connectors, said disk having cavities formed therein, apertures insulator plugs received in said cavities, a pair of hollow connector rods, the ends of said wire filament being inserted into said hollow connectors rods and crimped therein, and sleeves having reference shoulders thereon affixed to said connectors rods affixed to said filament, said sleeves being positioned to abut said insulator plugs and thereby position the tip of said filament in position to extend through said focal plane disk.

* * * * *